United States Patent [19]

Leifeld

[11] 4,150,461

[45] Apr. 24, 1979

[54] CLEANING OF TEXTILE FIBER TUFTS

[75] Inventor: Ferdinand Leifeld, Kempen, Fed. Rep. of Germany

[73] Assignee: Trützschler GmbH & Co. KG, Mönchen-Gladbach, Fed. Rep. of Germany

[21] Appl. No.: 862,602

[22] Filed: Dec. 20, 1977

[30] Foreign Application Priority Data

Dec. 22, 1976 [DE] Fed. Rep. of Germany ..... 2658072

[51] Int. Cl.[2] ..... D01J 7/00

[52] U.S. Cl. ..... 19/200; 19/303

[58] Field of Search ..... 19/200, 156.3, 156.4, 19/155, 65 R, 204, 205, 303; 209/466, 467, 470, 502

[56] References Cited

U.S. PATENT DOCUMENTS

| | | | |
|---|---|---|---|
| 2,269,085 | 1/1942 | Morgan | 19/156.4 X |
| 4,025,989 | 5/1977 | Naarding | 19/200 X |

*Primary Examiner*—Dorsey Newton

*Attorney, Agent, or Firm*—Spencer & Kaye

[57] ABSTRACT

In order to remove dust from textile fiber tufts, the tufts are conveyed by an air-penetrable, continuously advancing screening element and a single stream of air is passed a plurality of times through the screening element in order to alternately mix with and become separated from the tufts and the stream is given a net flow in the direction opposite to the direction in which the tufts are being conveyed by the screening element.

6 Claims, 1 Drawing Figure

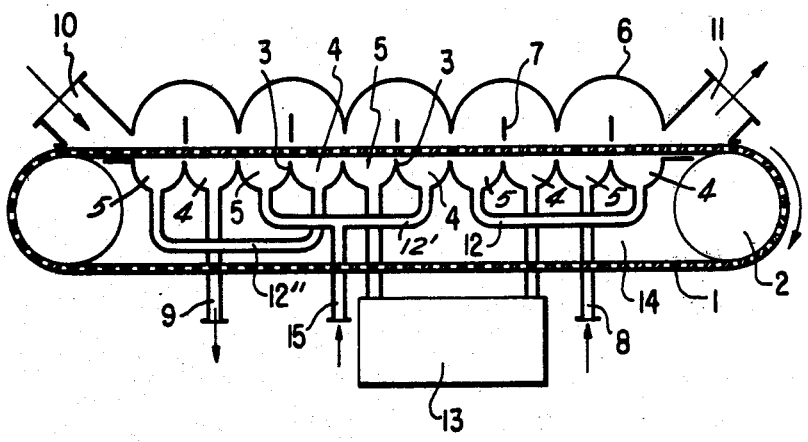
10
3
4
5
3
7
6
11
5
4
5
4
5
4
5
4
12'
12
12''
9
15
14
1
2
8
13

CLEANING OF TEXTILE FIBER TUFTS

BACKGROUND OF THE INVENTION

The present invention relates to a method and apparatus for removing dust by means of air, particularly from textile fiber, e.g. cotton, tufts, in which an air-penetrable, continuously rotating screening element conveying such tufts in the course of opening or picking operations continuously offers a new screening surface to a stream of cleaning air.

In known processes of this type a ventilator sucks air through a screening drum and produces a stream of air which sucks the textile fiber tufts from a preceding machine. The textile fiber tufts are separated from the stream of air at the screening drum and the dust is separated from the fibers by the sudden impact of the fibers against the drum. The dust released in this process is removed by the subatmospheric pressure in the suction region. Due to the fact that the textile fiber tufts strike the screening drum only once, the dust removal effect of this procedure is limited. The transporting air stream in this process is separated just once from the textile fiber tufts. A process in which a plurality of screening drums are connected in sequence would be too uneconomical.

In a known process for removing dust from textile fiber material, e.g. deseeded raw cotton, as disclosed in U.S. Pat. No. 2,269,085, the fiber material is delivered to a rotatable screening drum and is moved on thereby. On the outside of the screening drum there is mounted a housing with two semicircular passages. An air nozzle disposed on the inside of the screening drum blows the fiber material through the first semicircular passage and the dust laden air is then pulled through the screening drum into a first suction channel. The fiber material remaining on the screening drum is transported by the rotary movement of the drum to the adjacent semicircular passage. There a second air nozzle installed on the inside of the screening drum blows the material through this passage and at the end of that passage the air is drawn into a second suction channel. Finally, the material is removed from the screening drum by a roller. In this process a plurality of streams of cleaning air act on the textile fiber tufts, the direction of transport of the textile fiber tufts and the direction of net flow of the stream of air being identical. A separate pressure nozzle and suction channel are provided for each one of these streams of air. The apparatus required for this operation is very expensive. Moreover, this system has the drawback that it requires several separate streams of air, so that the total quantity of air that must be delivered is considerable.

SUMMARY OF THE INVENTION

It is an object of the present invention to improve the effectiveness of dust removal in such a system.

Another object of the invention is to simplify the apparatus required for effecting a high level of duct removal.

These and other objects are achieved, according to the present invention, in a method and apparatus for removing dust from textile fiber tufts while they are conveyed on an air-penetrable, continuously advancing screening element, by causing a single stream of air to alternately and repeatedly mix with, and separate from the fiber tufts at successive locations along the screening element while the air stream undergoes a net flow counter to the direction of advance of the screening element.

In the process according to the invention a cleaning air stream acts on the dust laden textile fiber tufts several times in succession. The stream of air is initially introduced into a first region of a path along which textile fiber tufts are conveyed. This produces an intensive agitation and mixing of the tufts which causes part of the dust present in the tufts to be transferred from the textile fiber tufts to the stream of air. The stream of air which has thus been enriched with dust leaves the first region, is deflected and introduced into a second region of the textile fiber tuft conveyance path where it is again mixed with the tufts. The significant aspect of this procedure is that the stream of cleaning air has a net flow in the direction opposite to that in which the textile fiber tuft is being conveyed.

Although the concentration of dust in the stream of cleaning air continuously increases when it acts on the tufts several times in this manner, the degree of dust removal from the textile fiber tufts is surprisingly quite considerable. In particular, an increase in the efficiency of dust removal is possible with the use of but a single system so that additional apparatus investment costs are avoided.

A particular advantage of the invention is that it requires a minimum of cleaning air so that the utilization of operating equipment is also optimized. The dust laden air need then be cleaned only once, for example by means of a filter.

According to a preferred embodiment of the invention, the stream of air is introduced to the fiber conveying path via a pressure conduit and is discharged from the path via a suction conduit. According to a further preferred embodiment, fresh air is introduced into the conveying path so that a partial stream of air is produced in this way.

BRIEF DESCRIPTION OF THE DRAWING

The sole FIGURE is a simplified cross-sectional, side elevational view of a preferred embodiment of apparatus according to the invention.

DESCRIPTION OF THE PREFERRED EMBODIMENTS

The FIGURE illustrates an apparatus in which a stream of cleaning air acts on textile fiber tufts a succession of times and flows according to the countercurrent principle in which the stream of cleaning air has a net flow in the direction opposite to the direction of conveyance of the fiber tufts. To convey the fiber tufts, there is provided an air-penetrable screening belt 1 which rotates about rollers 2. One of the rollers 2 is a driven roller connected to rotate at a speed which is continuously variable over a range.

A region between the forward, or upper, reach and the return, or lower, reach of the screening belt 1 is divided by devices 3 into suction zones 4 and air pressure zones 5, the suction and pressure zones being effective toward the upper reach of screening belt 1. Adjacent sets of suction and pressure zones 4, 5 produce relative suction and pressure effects in that air is at a higher pressure in each zone 5 than in its associated zone 4.

At the side of the screening belt 1 on which the textile fiber tufts are carried there are provided conduits 6 and guide sheets 7 defining deflection channels opposite devices 3.

During operation of the apparatus, dust laden textile fiber tufts are delivered to the screening belt 1 by a feed device 10 provided at one end of screening belt 1 and are removed at the opposite end by a discharging device 11. The stream of cleaning air enters the apparatus from a pressurized air source through a pressure channel 8 which is disposed near the end of the screening belt 1 associated with the discharging device 11 and leaves through a suction channel 9 which is connected to a suction pressure source and which is disposed near the end of screening belt 1 which is associated with the charging device 10.

The stream of air entering through pressure channel 8 initially passes into the pressure zone 5 of a first device 3 and passes through screening belt 1 and into the entrance region of an associated deflection channel 6, 7. It then flows around guide plate 7 and enters the discharge region of deflection channel 6, 7 and from there passes back through screening belt 1 and into the suction zone 4 of the first device 3. As the air stream passes through belt 1 while traveling from pressure zone 5 to the entrance region of channel 6, 7, the air stream becomes mixed with textile fiber tufts in its flow path and becomes separated therefrom when it again passes through belt 1, this time while flowing from the discharge region of channel 6, 7 to suction zone 4. The stream of air flows then from the suction zone 4 of the first device through a conveying conduit 12 into the pressure zone 5 of the next adjacent device 3, where the above-described operation is repeated. Thus, the air stream has a net flow opposite to the fiber tuft conveying direction in that it passes through devices 3 in succession from the downstream end of the conveying belt 1 to the upstream end thereof.

Only a single conveying path composed of conduits 12, 12' and 12'' is provided for the stream of air and all devices 3 with their suction and pressure zones 4, 5 are connected in series, one behind the other via this path. Therefore, the pressure in the air stream decreases progressively along the length of this path. At a point between the pressure channel 8 and the suction channel 9, a filter 13 for the intermediate cleaning of the stream of cleaning air is connected in series in the conveying path. The conveying path is ventilated with fresh air via a pipe connection 15.

It will be understood that the above description of the present invention is susceptible to various modifications, changes and adaptations, and the same are intended to be comprehended within the meaning and range of equivalents of the appended claims.

I claim:

1. In a method for removing dust from textile fiber tufts while the tufts rest on, and are conveyed in a conveying direction by, an air-penetrable, continuously advancing screening element, by alternately and repeatedly mixing the tufts with, and separating the tufts from, cleaning air, the improvement wherein said steps of mixing and separating are carried out by providing the cleaning air in the form of a single stream which passes through the screening element and the tufts thereon a plurality of times transverse to the conveying direction with each passage being opposite in direction to the preceding passage, so as to cross the conveying path several times in succession and remove dust from the tufts, and by causing the stream of air to have a net flow opposite to the conveying direction.

2. Method as defined in claim 1 further comprising adding fresh air to the stream of air.

3. Method as defined in claim 1 further comprising filtering the stream of air at least once between a separating step and subsequent mixing step.

4. Apparatus for removing dust from textile fiber tufts, comprising: a continuously advancing, air-penetrable screening element for supporting textile fiber tufts and conveying such tufts in a conveying direction along a conveying path; means for delivering textile fiber tufts to said element at the inlet end of the conveying path; means for withdrawing textile fiber tufts from said element at the outlet end of the conveying path; means defining a plurality of air deflection channels disposed adjacent said element at the side thereof on which the textile fiber tufts are supported and spaced along the conveying path; and air guidance means disposed at the opposite end of said element from said air deflection channels and connected between a pressurized air delivery source and an air evacuation device, said air guidance means cooperating with said deflection channels to establish a single air flow stream which passes through the screening element and the tufts thereon a plurality of times transverse to the conveying direction, with each passage being opposite in direction to the preceding passage, so as to cross the conveying path several times in succession and remove dust from the tufts, and said air guidance means being connected to the air delivery source and the air evacuation device at locations such as to cause the air flow stream to have a net flow opposite to the conveying direction between the air delivery source and the air evacuation device.

5. An arrangement as defined in claim 4 further comprising a dust filter connected in the path of the air flow stream between successive air deflection channels.

6. Method as defined in claim 1 wherein the stream of air is caused to have a net flow opposite to the conveying direction by causing each successive mixing step and separating step to occur at a region which is upstream of the region of the preceding mixing and separating, with respect to the conveying direction.

* * * * *